United States Patent [19]

Hauser et al.

[11] 4,163,895

[45] Aug. 7, 1979

[54] ELECTROLYTIC WATER HEATER

[76] Inventors: Stephen G. Hauser, 6267 Variel Ave., Woodland Hills, Calif. 91364; John G. Bowen, 11521 Heathcliff Dr., Santa Ana, Calif. 92705

[21] Appl. No.: 590,050

[22] Filed: Jun. 25, 1975

[51] Int. Cl.[2] ..... H05B 3/60; H01C 10/02

[52] U.S. Cl. ..... 219/290; 13/23; 219/288; 219/506; 338/80

[58] Field of Search ..... 219/284–295, 219/271–276, 506; 338/80–86; 21/119; 13/23

[56] References Cited

U.S. PATENT DOCUMENTS

| | | | |
|---|---|---|---|
| 1,441,610 | 1/1923 | Topp | 219/290 |
| 1,507,120 | 9/1924 | Keep et al. | 219/284 UX |
| 1,546,061 | 7/1925 | Drefahl | 219/285 X |
| 1,550,164 | 8/1925 | Heinrich | 219/285 |
| 1,685,266 | 9/1928 | Baum | 219/284 X |
| 2,301,646 | 11/1942 | Stapleton | 219/289 |
| 2,729,737 | 1/1956 | Choussy | 219/290 |
| 3,008,031 | 11/1961 | Chambers | 219/288 X |
| 3,585,362 | 6/1971 | Hoogesteger | 219/284 UX |
| 3,664,929 | 5/1972 | White et al. | 219/284 X |
| 3,780,260 | 12/1973 | Elsner | 219/284 X |

FOREIGN PATENT DOCUMENTS

| | | | |
|---|---|---|---|
| 440125 | 1/1927 | Fed. Rep. of Germany | 219/288 |

*Primary Examiner*—A. Bartis

*Attorney, Agent, or Firm*—Keith D. Beecher

[57] ABSTRACT

An electrolytic water heater is provided which has general utility for heating and boiling water, or other electrically conductive solutions, by passing an electric current through the solution. The heater includes a housing composed of electrically nonconductive material, whose interior is divided by a common wall into two separate chambers. An opening is provided in the common wall of restricted dimensions which may be in the form of a slot in the upper edge of the wall, and the solution in the two chambers extends into the opening to complete an electrical path through the solution in the two chambers. Two electrodes are respectively mounted in the chambers in contact with the solution in the two chambers. An electric voltage is applied across the electrodes to produce a current flow through the solution, so as to heat the solution in the opening in the common wall to the boiling point, without producing cavitation in the solution in the vicinity of the electrodes.

4 Claims, 3 Drawing Figures

ELECTROLYTIC WATER HEATER

BACKGROUND OF THE INVENTION

Electrolytic water heaters are known in which water, or other solutions, are heated by passing an electric current through the solution from one electrode to another, the electrodes being mounted to be in contact with the solution. Problems have been encountered, however, in the prior art electrolytic heaters.

One problem is that when ordinary tap water is used in an electrolytic heater, the conductivity of the tap water varies from one locality to another, and this produces design problems in the construction of the heaters due to the varying amount of heat produced by any given physical configuration as different tap water is used. Also, under normal circumstances, if chemicals, such as sodium chloride, sodium bicarbonate, or the like, are added to increase the conductivity of the tap water, difficulties are encountered in controlling the heating rate and boiling of the solution, since the heating rate is a function of the quantity of the added chemicals. Also, if the solution boils dry in the heater, the added chemicals, as well as minerals normally contained in the tap water, appear as deposited film on the inner surfaces of the wall of the housing of the heater, and these present cleaning problems.

Because of the foregoing, it is suggested in the heater of the present invention that distilled water be used, with a predetermined amount of sodium chloride added, so as to provide an electrically conductive solution which will be standard for all the heaters, wherever the heaters may be used.

Problems still arise in the construction of electrolytic water heaters, even when distilled water is used. For example, if the heating rate is controlled by limiting the area of the electrodes exposed to the solution in the heater, cavitation of the solution at the electrode contact surfaces often occurs, and this leads to arcing, electrode pitting, and a shortening of useful electrode life.

Cavitation of the solution at the electrodes, and its attendant deleterious effects, is obviated in the electrolytic heater of the present invention by the provision of two separate chambers in the heater housing, one for each electrode; the chambers being designed to hold the desired quantity of the solution which is to be heated. The two chambers are interconnected, as stated above, by means of an opening or channel in the wall between the chambers into which the liquid from the two chambers extends. This channel has reduced dimensions with respect to the dimensions of the chambers, and the boiling of the liquid occurs in the channel. This eliminates the generation of bubbles in the vicinity of the electrodes so that erosion effects are obviated.

In brief, the construction of the present invention, in which the two electrodes are mounted in separate chambers, and in which boiling of the solution occurs in an interconnecting channel or slot of reduced dimensions, removes the cavitation effects from the electrodes themselves, so that the electrodes are not subjected to erosion during the operation of the heater.

One use for the heater of the invention is for sterilizing soft contact lenses for the eyes. The lenses are placed in a separate receptacle which is filled with a saline solution, and the receptacle is inserted above the slot or channel in the common wall of the heater, the saline solution in the receptacle being heated by the steam produced by the boiling solution in the channels, so as to perform the desired reaction on the contact lenses in the receptacle.

DETAILED DESCRIPTION OF THE ILLUSTRATED EMBODIMENT

Figure 1:
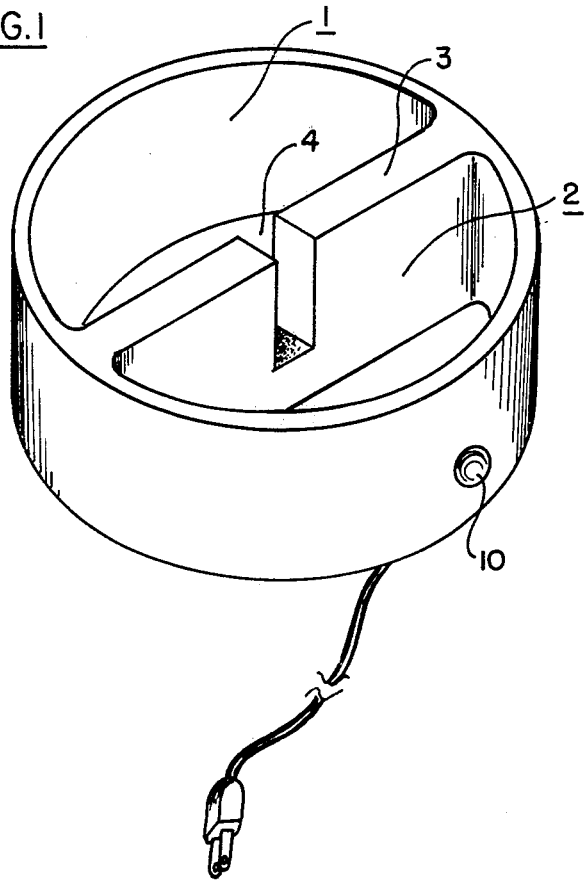
FIG. 1 is a perspective representation of an electrolytic heater constructed in accordance with one embodiment of the invention, and with the cover removed to reveal the configuration of the interior of the housing of the heater.
Figure 2:
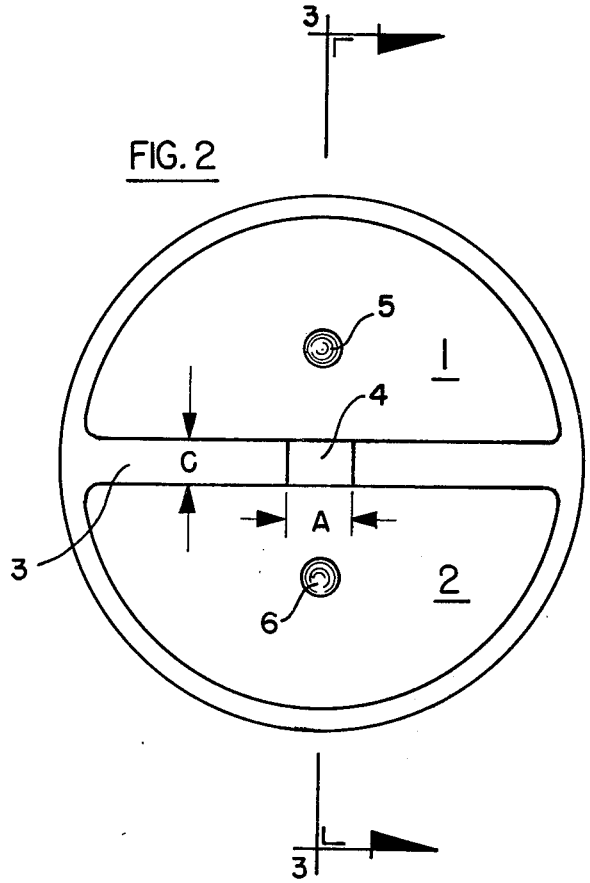
FIG. 2 is a top plan view of the heater of FIG. 1.
Figure 3:
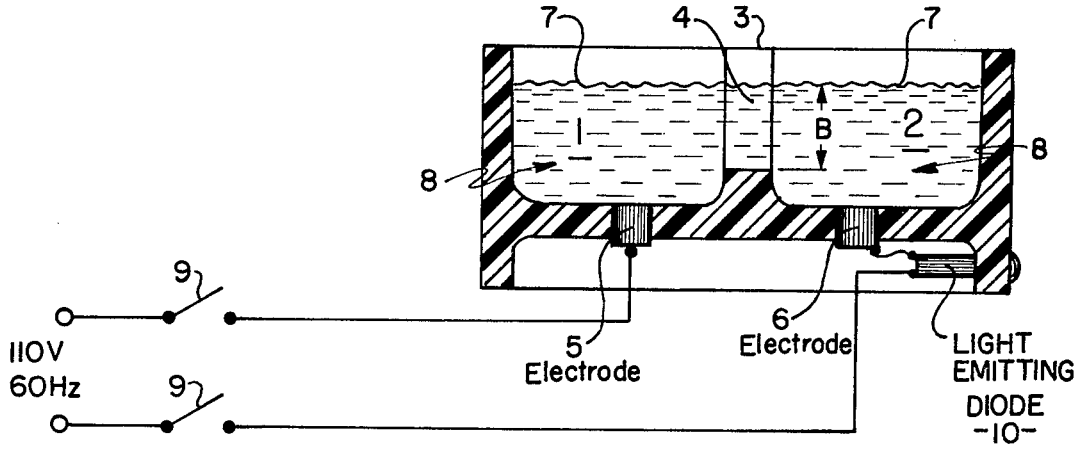
FIG. 3 is a cross-sectional view taken along the line 3—3 of FIG. 1.

In the embodiment of FIGS. 1-3, the heater has a cylindrical-shaped housing with a bottom and a side wall. A common wall 3 extends across the interior of the housing to separate the housing into two chambers 1 and 2. The common wall 3 has a central slot or channel 4 formed in it upper edge, with the slot extending downwardly to a plane displaced up from the bottom of the housing.

A pair of electrodes 5 and 6 are mounted in the bottom of the housing, and these electrodes extend upwardly into the respective chambers 1 and 2. The electrodes 5 and 6 may, for example, be formed of carbon, or other suitable electrically conductive material.

An electrically conductive solution 8 is poured into the housing of the heater to fill the chambers 1 and 2, and to extend into the channel 4, at a level 7, as best shown in FIG. 3. A switch 9 connects the electrodes 5 and 6 across the usual 120-volt 60 Hz alternating current source, so that when the switch is closed, a voltage is applied across the electrodes which causes a current to flow through the solution in the chambers 1 and 2. A light emitting diode 10, or other appropriate electrically energized indicator is connected in series with the electrodes 5 and 6, to glow whenever the electrodes are energized. The indicator 10 may be observed through the side wall of the housing, as best shown in FIG. 1.

Therefore, the housing is divided into two chambers 1 and 2 by means of the common wall 3, with the slot 4 being formed in the common wall. The electrodes 5 and 6 are provided to make electrical contact with the solution in the chambers. In a constructed embodiment, the electrodes 5 and 6 are formed of carbon rods having their ends flush with the top surface of the bottom of the housing. As stated above, it is preferred for the production of steam in the slot 4 to use distilled water in the chambers 1 and 2 as the solution 8, to which a quantity of sodium chloride has been added, to form a solution of sufficient salinity to permit the water to carry the electrical current between the electrodes 5 and 6.

If there were no common wall 3 separating the two chambers 1 and 2, the unit would pass a relatively large current when the electrodes 5 and 6 are connected to the normal 120-volt 60 Hertz power line, and local boiling in the vicinity of the electrodes 5 and 6, with resulting electrode arcing and erosion, would result. However, with the common wall 3 in position, all the current must flow through the solution contained in the slot or channel 4. The cross-sectional area of the channel 4 is selected to have reduced dimensions, so that a predetermined current flow through the unit may be provided by the selected dimensioning of the channel or slot 4. In this way, boiling occurs only in the channel 4, and cavitation in the vicinity of the electrodes 5 and 6 is prevented.

If the channel 4 is assumed to have a width A, and if B is the depth of the solution from the level 7 to the bottom of the channel 4; and if C represents the thickness of the common wall 3, then the resistance of the solution in the slot is proportional to C/A·B. By appropriate choosing of the dimensions of the unit, the equivalent resistance of the solution within the channel 4 can be made much larger than the sum of the resistance of the solution in the chambers 1 and 2. Since the power dissipation or heating effect in an electric circuit is given as:

$$P = I^2R$$

where: P is power in watts
I is current in amperes
r is resistance in ohms.

Then, by causing the resistance of the solution in the channel 4 to be large compared with the resistance of the solution in the chambers 1 and 2, most of the power is developed in the channel 4 so that boiling occurs in the channel and localized boiling and arcing at the electrodes themselves does not occur.

When the unit is first turned on, the resistance of the solution in channel 4 controls the current flow to a safe value giving a desirable fairly rapid warm-up and boiling action in the channel. As boiling starts in the channel, the formulation of steam bubbles begins, and the current flow and power consumption is reduced to a desirable lower level sufficient to maintain boiling action in the channel. Convection currents in the solution are set up in the individual chambers 1 and 2 which tend to equalize the liquid temperature in the chambers, with boiling being confined only to the channel area. Current control by steam bubble formation is seen to be somewhat self-regulating since a decrease in boiling rate means less bubble formation and thus more average current flow which tends to increase the boiling rate. An increase in boiling rate, on the other hand, develops more bubbles and thus reduces the average current flow which tends to reduce the boiling rate.

In the embodiment of FIGS. 1–3, the channel 4 does not extend to the bottom of the chambers 1 and 2. The boiling action will stop when enough of the solution is boiled away so that the liquid level is at the level of the bottom of the channel with no liquid bridging through the channel. The advantage of this is that the unit turns itself off after the solution has boiled down to a certain minimum, and also in that the chemical additive, such as the sodium chloride, remains dissolved in the remaining solution in the chambers 1 and 2, and does not deposit on the surface of the housing. Therefore, when the remaining solution is poured out, the unit is left with a relatively clean surface free from crystallized chemical salt.

It will be appreciated that by making the channel 4 in the common wall 3 in a selected geometrical configuration other than rectangular, the boiling rate versus time or liquid level may be modified to some extent. For example, the channel 4 may be made narrower at the bottom than at the top of the common wall 3, or it may be made wider at the bottom than at the top, depending upon the requirements of the individual apparatus. In this way, the boiling rate can be made to vary as the liquid level drops. Other forms of openings in the common wall are also usable. A simple round or rectangular hole may be most suitable for some applications. The choice of opening may also be based upon ease of fabrication.

In the configuration of FIG. 1, a channel, such as the channel 4, may be chosen if the entire unit is to be injection molded from plastic material, since the channel can be easily incorporated in a simple molding tool, where an opening such as a hole may require expensive tooling or secondary manufacturing operation.

The light emitting diode indicator 10 provides a visual indication of the current flow through the solution. An appropriate protective means is provided for the indicator 10 by circuitry well known to the art, to prevent the indicator from becoming overloaded or burned out by excessively high current.

The invention provides, therefore, an improved electrolytic heater which may be used for boiling water, or other solutions, without creating erroding effects to the electrodes.

While particular embodiment of the invention has been shown and described, modifications may be made. It is intended in the claims to cover the modifications which come within the spirit and scope of the invention.

What is claimed is:

1. An electrolytic heater for an electrically conductive solution comprising: a housing formed of electrically insulating material having an open top and a closed bottom for receiving the solution through its open top; a wall extending across the interior of the housing for separating the interior into two chambers, said wall having an opening therein in the form of a channel in the upper edge of the wall intermediate the ends thereof, said channel extending downwardly from the upper edge to a plane displaced up from the bottom of the two chambers, said opening having reduced dimensions with respect to the dimensions of the individual chambers for receiving the solution from the two chambers thereto to intercouple the solution in the two chambers; first and second electrodes mounted in said housing and extending through said bottom thereof into respective ones of said two chambers in position to establish respective electric contact with the solution in the two chambers; and means for connecting the electrodes to a source of electrical power.

2. The heater defined in claim 1, in which said electrodes are formed of carbon.

3. The heater defined in claim 1, in which said housing has a cylindrical shape, and said wall extends diametrically across the housing from one side thereof to the other.

4. The heater defined in claim 1, and which includes an electrically energized light emitting device connected in series with the electrodes to be illuminated when the heater is energized.

* * * * *